United States Patent [19]

Tribert et al.

[11] Patent Number: 4,953,600

[45] Date of Patent: Sep. 4, 1990

[54] METHOD AND APPARATUS FOR TRANSFERRING A PREDETERMINED PORTION TO A CONTAINER

[75] Inventors: Claude Tribert, Bedminster; Felix R. Grat, Parsippany, both of N.J.

[73] Assignee: Howden Food Equipment, Inc., Boston, Mass.

[21] Appl. No.: 338,873

[22] Filed: Apr. 14, 1989

[51] Int. Cl.[5] ..... B65B 3/04

[52] U.S. Cl. ..... 141/1; 222/275; 141/165; 141/168; 141/170; 141/171; 141/174; 141/180; 141/185; 141/237; 141/258

[58] Field of Search ..... 141/129, 135, 137, 165, 141/168, 169, 170, 171, 174, 176, 178, 179, 180, 183, 184, 185, 234, 237, 238, 242, 258, 284, 250, 1, 2.66; 222/275, 276, 263, 389

[56] References Cited

U.S. PATENT DOCUMENTS

| | | | |
|---|---|---|---|
| 2,501,004 | 3/1950 | Reese | 222/263 X |
| 3,222,167 | 5/1967 | Rosen | 141/169 |
| 3,621,891 | 11/1971 | Eisenberg | 141/1 |
| 3,804,135 | 4/1974 | Waxlax | 141/266 |
| 3,903,941 | 9/1975 | Eisenberg | 141/171 X |
| 3,994,321 | 11/1976 | Eisenberg | 141/1 |
| 4,319,517 | 3/1982 | McCaleb | 141/258 X |
| 4,537,231 | 8/1985 | Hasskamp | 141/238 |
| 4,569,378 | 2/1986 | Bergandy | 141/266 |
| 4,576,209 | 3/1986 | Eisenberg | 141/1 |
| 4,754,785 | 7/1988 | Eisenberg | 141/1 |

*Primary Examiner*—Ernest G. Cusick

*Attorney, Agent, or Firm*—Kenyon & Kenyon

[57] ABSTRACT

A device for discharging material from a succession of filled open top transfer receptacles includes a guide-holder having a pair of elongated parallel spaced-apart deadplates extending from an input end of the device toward an output end of the device. The spacing of the deadplates is sufficient to slidably receive the height of a transfer receptacle, and the length of the deadplates is sufficient to contain at least one transfer receptacle in a single station, and preferably two contiguous transfer receptacles in respective first and second stations. With two stations, the deadplates prevent loss of material from a receptacle in the first station but have openings in the second station to permit discharge of the contents of an inverted transfer receptacle in the second station. A pushing mechanism shifts each successively filled transfer receptacle, in response to its arrival at a location adjacent to the input end of the device, into the first station of the guide holder, and a rotating drive rotates the guide holder in a 180 degree increment about an axis parallel to the length dimension of the deadplates upon completion of each actuation of the pushing mechanism.

21 Claims, 8 Drawing Sheets

METHOD AND APPARATUS FOR TRANSFERRING A PREDETERMINED PORTION TO A CONTAINER

BACKGROUND OF THE INVENTION

1. Technical Field

The invention relates to a method and apparatus for transferring predetermined portions of material, such as food items, from a filling zone to a second delivery zone where the portion is delivered to a container. In particular, the invention relates to a method and apparatus for moving a transfer receptacle holding a predetermined portion of material from a filling zone to a delivery zone and inverting the transfer receptacle at the delivery zone to deliver the portion to a container, such as a tray.

2. Description of the Related Art.

U.S. Pats. No. 4,576,209 and No. 4,754,785 of EISENBERG disclose an apparatus for delivering fibrous or particulate materials, such as food materials, from a shaker pan onto a rotating turntable provided with radial gutters, each gutter delivering material to a corresponding hopper located at the periphery of the turntable. Each hopper is mounted on a radially extending rotatable arm, and when the hopper reaches a discharge station, the arm is actuated to rotate 180°, inverting the hopper and delivering its contents through a funnel into a container below.

Earlier EISENBERG patents disclose other arrangements for transferring predetermined quantities of particulate materials from a rotary drum tumble type filler via an endless line of intermediate receptacles to a separate line of moving containers at a delivery station outside the drum filler. These include U.S. Pats. No. 3,517,705, No. 3,621,891, No. 3,990,209, and No. 3,994,321.

In No. 3,517,705, the bottom of each intermediate receptacle is supported by an arm having an opposite end that pivots about an axis coinciding with the longitudinal axis of an endless conveyor line that transports the intermediate receptacles through a drum filler. When a filled receptacle reaches the delivery station, the arm pivots through 180 degrees to invert the receptacle to discharge into containers moving on a line below. The intermediate receptacles in No. 3,621,891 have hinged bottoms that trip open to discharge the contents when each receptacle reaches the delivery station. In Nos. 3,990,209 and 3,994,321, the intermediate receptacles have no bottoms and slide along a deadplate until they reach the delivery station.

In all of the above-described transfer filling systems, the intermediate transfer receptacles are connected to an endless conveyor that transports them from the filling station to the delivery or discharge station. Often, it is desirable to change the size or capacity of the intermediate receptacles, and this can be time consuming if each receptacle has to be disconnected and another connected. Also, the connection devices add complication and expense, as well as maintenance and cleaning problems.

SUMMARY OF THE INVENTION

An object of the present invention is to deliver a predetermined amount of material from each of a series of independent intermediate transfer receptacles to corresponding containers in one or more parallel lines of containers.

Another object of the invention is to provide an intermediate transfer receptacle having a plurality of predetermined adjustably selectable capacities.

Still another object of the invention is to provide an intermediate transfer receptacle capable of positively expelling its contents.

The present invention includes an apparatus and a method for accomplishing the above and other objects simply and economically, while permitting flexibility in plant layout.

The apparatus of the invention includes a discharge device having an input end and an output end and means for transporting filled open top transfer receptacles from a filling apparatus to the input end of the discharge device and for returning empty transfer containers from the output end of the discharge device to the filling apparatus, wherein the discharge device comprises:

a guide holder comprising a set of elongated parallel spaced apart guides extending from the input end of the discharge device toward the output end, the spacing of the guides being sufficient to slidably receive and support a transfer receptacle, the length of the guides being sufficient to contain at least one transfer receptacle, and the guides providing an opening for permitting discharge of the contents of a transfer receptacle through the open top of the receptacle;

means for rotating the guide holder in 180° increments about an axis parallel to the length dimension of the guides; and means for shifting a transfer container from a location at the inlet end of the discharge device into the guide holder.

In one preferred embodiment, the set of guides may comprise a pair of elongated parallel spaced apart deadplates extending from the input end of the discharge device toward the output end, the spacing of the deadplates being sufficient to slidably receive the height of a transfer receptacle, the length of the deadplates being sufficient to contain two contiguous transfer receptacles in a first station located at the input end of the discharge device and a second station next to the first station, respectively, and each deadplate being imperforate in the first station and having an opening in the second station for permitting discharge of the contents of a transfer receptacle through the open top of the receptacle;

The apparatus also may include means for synchronizing operation of the rotating means and the shifting means so as to actuate the shifting means for one cycle in response to the arrival of a transfer receptacle at the inlet end of the discharge device and to actuate the rotating means for a 180° cycle in response to completion of an actuation cycle of the shifting means.

Preferably, the transfer receptacle of the invention comprises an open-ended hollow cylindrical body and a piston-like member slidably fitted in the cylindrical body. In one embodiment, one end of the body is the top and the other end is the bottom, and the receptacle further includes a stop mounted at one of a plurality of predetermined axially spaced locations adjacent to the bottom of the body to provide a corresponding plurality of selectable capacities for the receptacle when the piston-like member is resting against the stop. In an alternative version, each end of the body may be interchangeably the top or the bottom, and the length of the piston can be varied to obtain selectable capacities. For example, the piston may be double ended, comprising two disks spaced apart by adjustable connecting means such as an internally threaded nut on one disk and an externally threaded stud on the other disk.

When used with the preferred transfer receptable, the apparatus of the invention may further comprise means located above the guide support for urging the piston like member toward the inverted open top of the receptacle body to assure complete discharge of the contents of the receptacle.

In the method of the invention, which includes filling each of a series of open top transfer receptacles with a predetermined amount of material at a filling zone, conveying the filled transfer receptacles in a line from the filling zone to a delivery zone, discharging the contents of successive transfer receptacles into a succession of containers in the delivery zone; and returning the empty transfer receptacles to the filling zone, the step of discharging the contents of successive transfer receptacles comprises:

(a) shifting a filled transfer receptacle from an input end of the delivery zone transversely to the line of containers into the delivery zone;

(b) rotating the receptacle in the delivery zone 180 degrees about an axis parallel to the shift direction to invert the receptacle;

(c) discharging the contents of the inverted receptacle into one of a line of containers passing underneath the delivery zone;

(d) shifting a subsequently arriving filled transfer receptacle from the input end of the delivery zone transversely to the line of containers into the delivery zone, the subsequent receptacle displacing the previous receptacle toward the output end of the delivery zone; and (e) repeating steps (b) through (d) as successive filled receptacles arrive at the input end of the delivery zone.

If the above defined method of the invention is practiced with the preferred receptacle embodiment in which the piston-like member is double-ended and either end of the cylindrical body can be the top or the bottom of the receptacle, the delivery zone need contain only one receptacle at a time. In that case, the previous receptacle in step (d) is displaced by the subsequent receptacle directly to the output end of the delivery zone for return to the filling zone. On the contrary, if the method is practiced with a transfer receptacle that has a predetermined top end, the method includes further steps so that the receptacles are not shifted to the output end of the delivery zone until they are returned to the upright condition. In that case, the step of discharging the contents of successive transfer receptacles comprises:

(a) shifting a filled transfer receptacle from an input end of the delivery zone into a first station of the delivery zone;

(b) rotating the receptacle in the first station 180 degrees about an axis parallel to the shift direction while covering the open top of the receptacle to prevent discharge of the contents therefrom;

(c) shifting a subsequently arriving filled transfer receptacle into the first station to discharge the contents of that receptacle into one of a line of containers passing underneath the delivery zone;

(e) rotating the receptacles in the first and second stations 180 degrees about the axis defined in step (b); and (f) repeating steps (c) through (e) as successive filled receptacles arrive at the input end of the delivery zone.

These and other features and advantages of the invention will become apparent and will be more readily appreciated from the following detailed description of the preferred embodiments, taken in conjunction with the accompanying drawings.

DETAILED DESCRIPTION OF THE PREFERRED EMBODIMENTS

Figure 1:
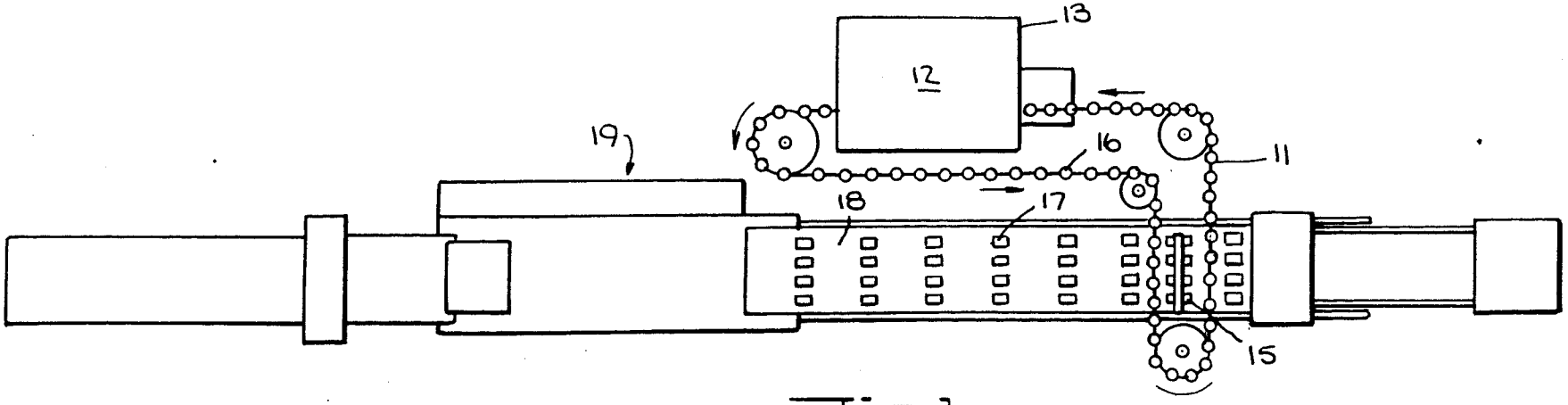
FIG. 1 is a simplified plan view of a transfer filling system according to the invention.

In the several figures the same reference numerals will be used for the same elements.

With reference to FIG. 1, an example of a transfer filling system 10 incorporating the method and apparatus of the invention includes an endless conveyor line 11 that loops, in the direction of the arrows, between a filling zone 12 in a filling machine 13 and a delivery zone 14 having one or more discharge devices 15. In FIG. 1, the system has four discharge devices. The conveyor line carries a series of transfer receptacles 16 that are filled with a predetermined amount of material in the filling zone of the filling machine. The material is then discharged from each transfer receptacle, by means of the discharge devices in the delivery zone, into a corresponding one of a series of containers 17 carried on a moving belt 18 underneath the discharge devices.

The filling machine preferably is a rotary drum tumble filler of the type disclosed in U.S. Pat. No. 3,903,941. In drum fillers of this type, open top receptacles moving in a line parallel to the drum axis are tilted and rocked or shaken while passing under the discharge edge of a shaker pan that receives material from shelves along the inside of the rotating drum. The tilting and shaking settles the material in the receptacles and causes any excess to drop back into the bottom of the drum. Although this type of filler is preferred for use with the present invention, other filling apparatus that provides an accurate and repeatable fill in the open top receptacles can be used.

The containers 17 typically are trays for frozen food dinner portions. The trays are fed onto the moving belt in one or more lines, depending on the number of discharge devices employed by the system. In the system of FIG. 1, there are four discharge devices feeding into four lines of trays. After filling, the trays are carried by the belt to a packaging machine 19 where they are wrapped in film and boxed. The application of the invention need not be limited to a rigid tray, however. For example, the transfer receptacles could deposit their contents into a web of thermo-formed pockets on a horizontal form-fill-seal machine or over a tube on a bag maker, and so forth.

Figure 3:
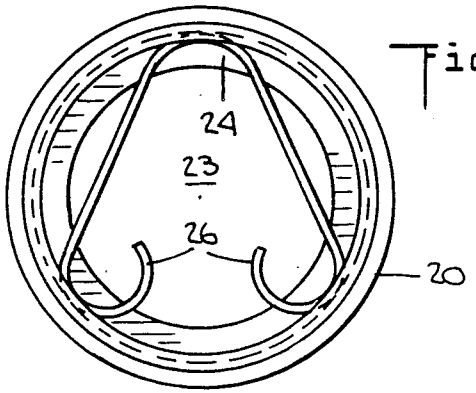
FIG. 3 is a bottom end view of the transfer receptacle of FIG. 2.
Figure 2:
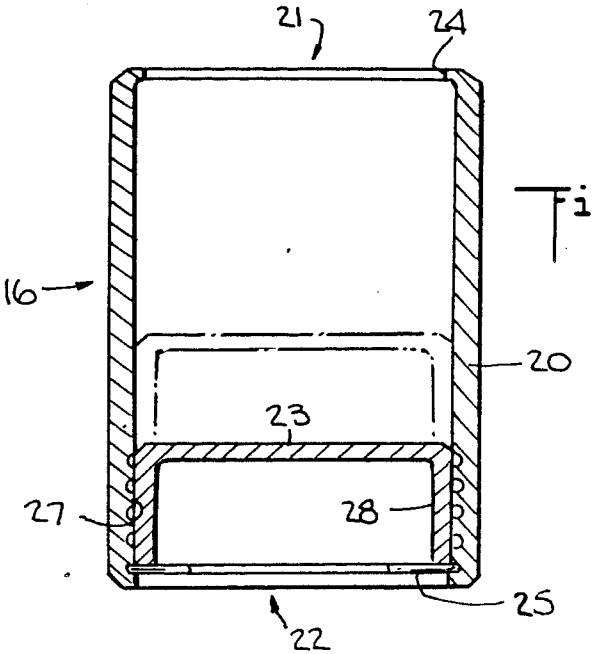
FIG. 2 is a longitudinal cross section of one preferred embodiment of a transfer receptacle.

FIGS. 2 and 3 illustrate a preferred transfer receptacle 16 for use in the above-described system. The receptacle includes a cylindrical body 20 having an open top 21 and an open bottom 22. A piston-like member 23 fits slidably in the receptacle body. An inner lip 24 prevents the member 23 from sliding out of the top of the body, and a removable stop 25 performs the same function at the bottom of the body. Stop 25 is in the form of a spring wire bent into a generally V-shape and provided with finger loops 26 at the outer ends of the V. The stop can be inserted in any one of a plurality of axially spaced circumferential grooves 27 located adjacent to the bottom of the receptacle body by compressing the spring with a thumb and a finger placed in the finger loops. Depending on which groove is selected, the stop provides an adjustable range of capacities for the receptacle, as illustrated by the solid and dashed line positions of the piston-like member 23 in FIG. 2. Also shown in FIG. 2, the member 23 has a skirt 28 which is long enough to cover all of the grooves 27 when the stop is in the bottom groove. This prevents the material with which the container is filled from collecting in the grooves.

Figure 4:
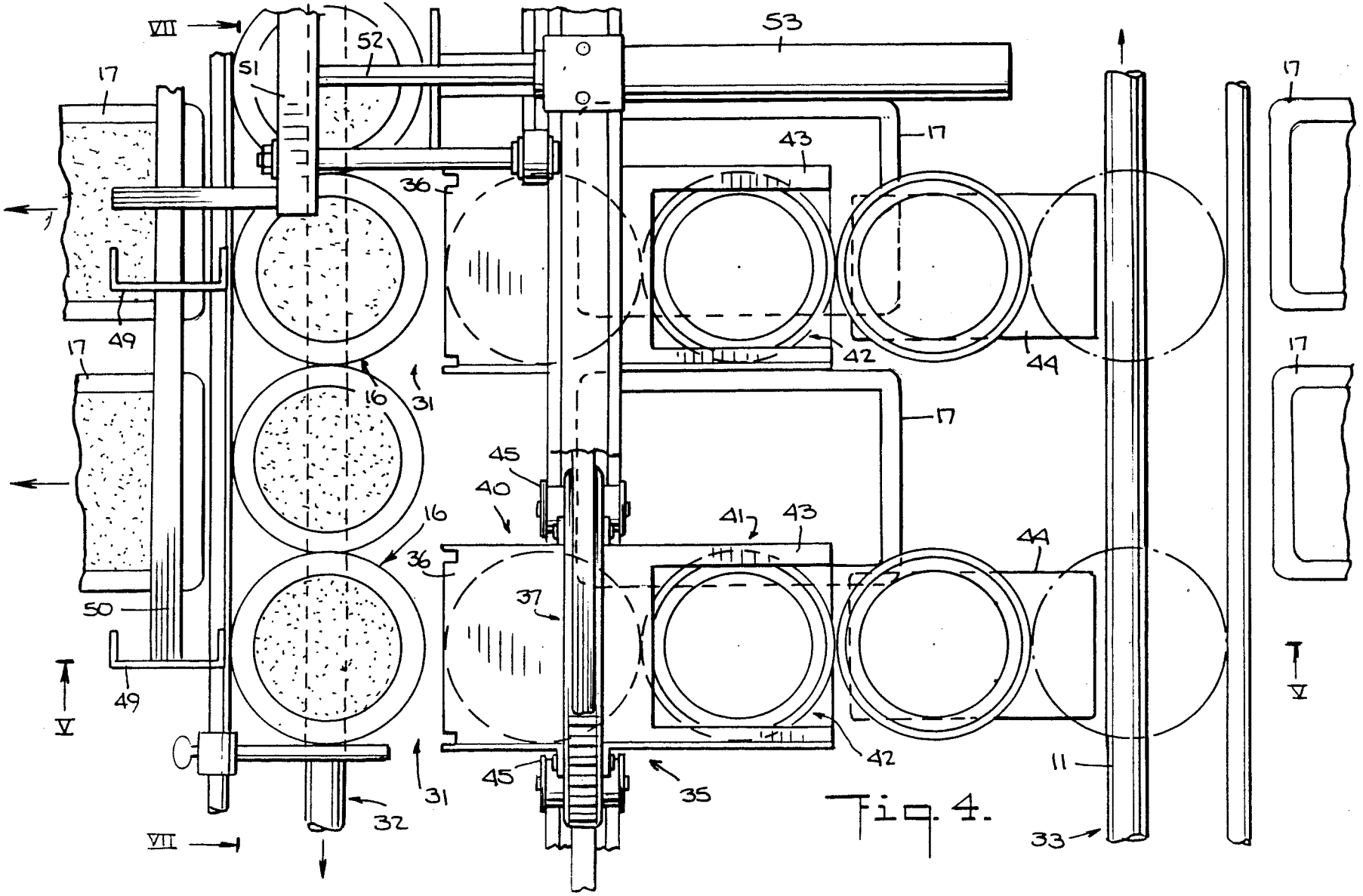
FIG. 4 is a detail plan view at an enlarged scale of a portion of the delivery zone of the system of FIG. 1.
Figure 5:
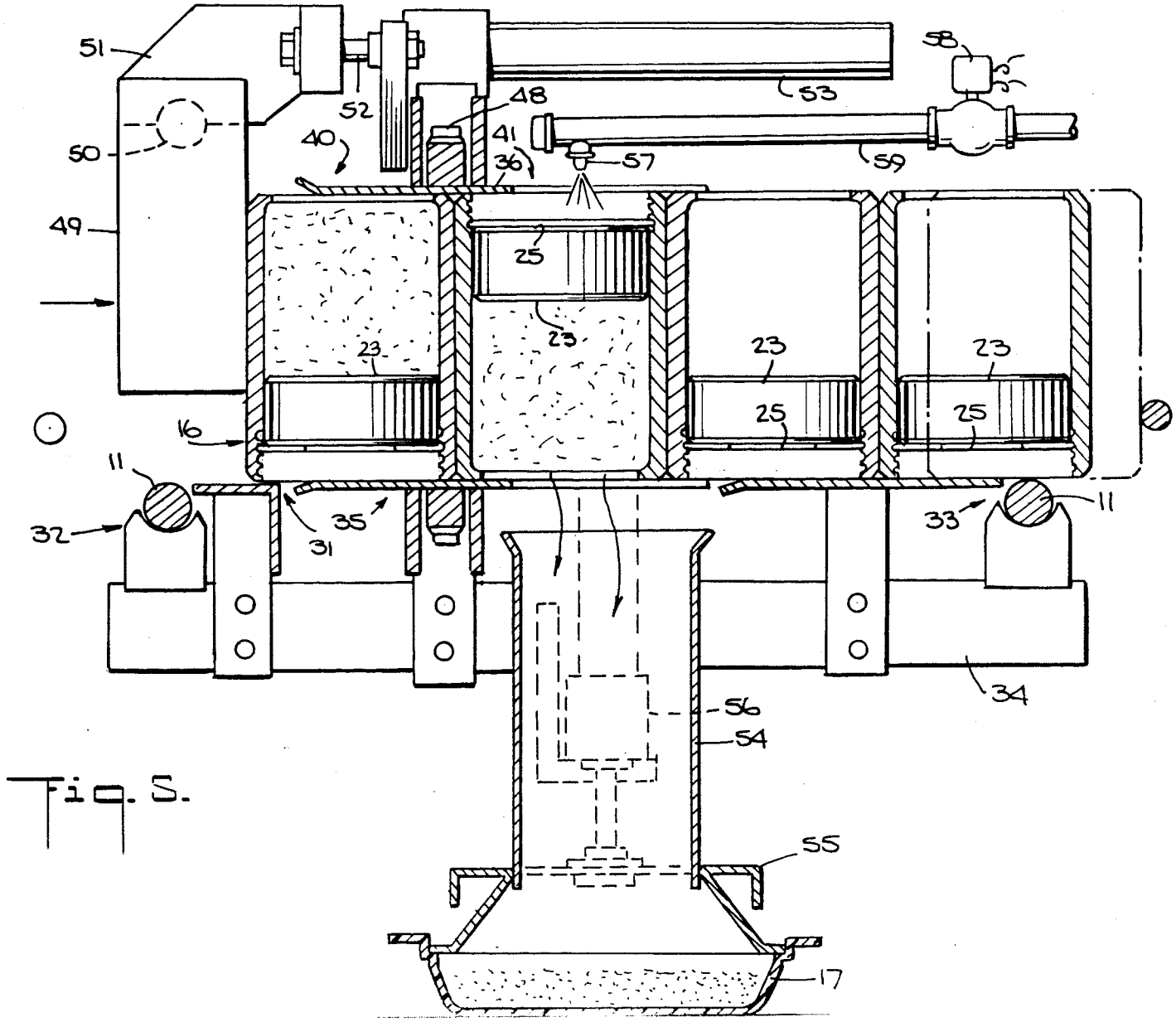
FIG. 5 is a cross-sectional elevation view taken in the direction of arrows V—V in FIG. 4.
Figure 6:
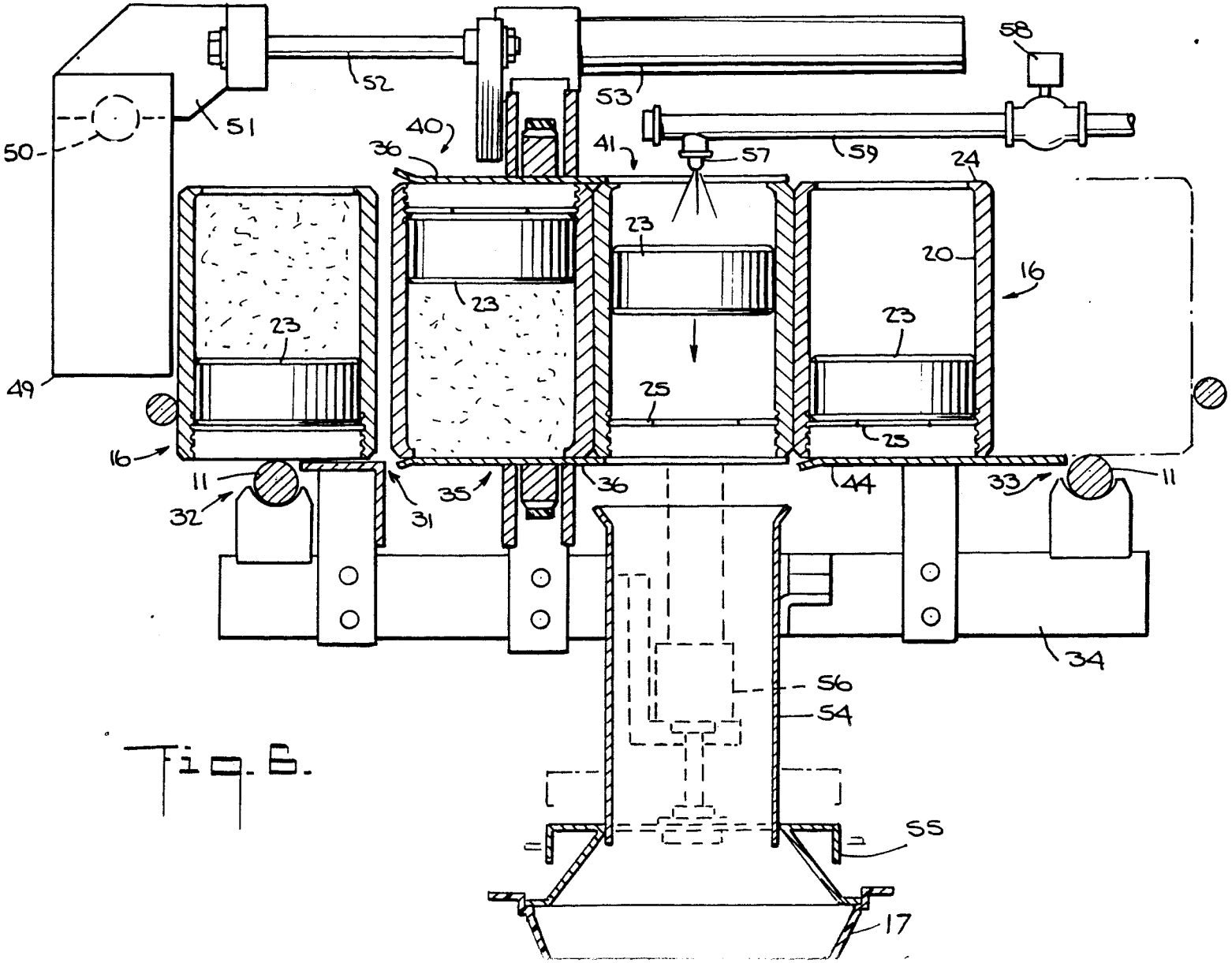
FIG. 6 is a cross-sectional elevation view similar to FIG. 5 but taken at a different stage in the discharge cycle.
Figure 7:
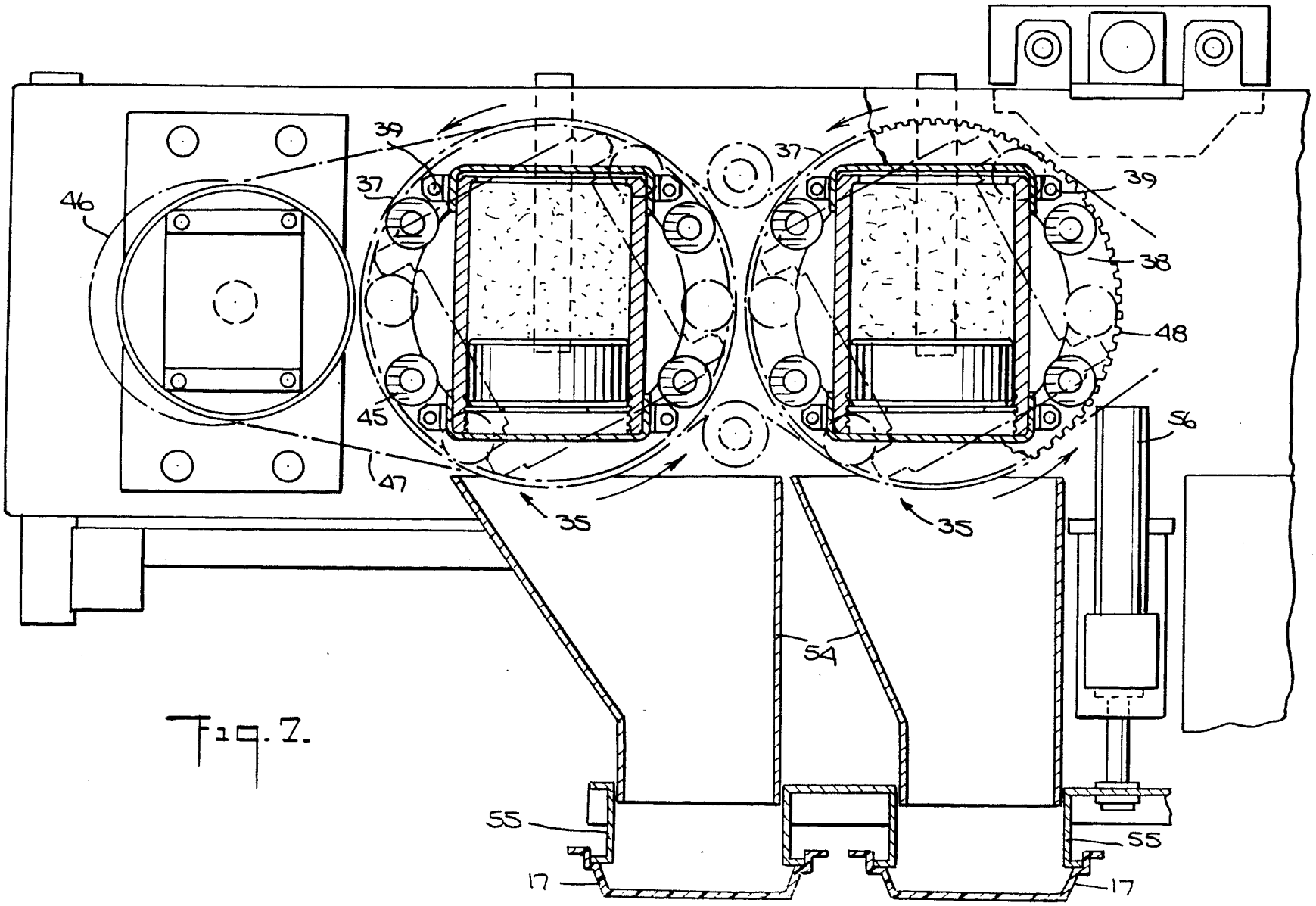
FIG. 7 is an end elevation view taken in the direction of arrows VII—VII in FIG. 4.
Figure 8:
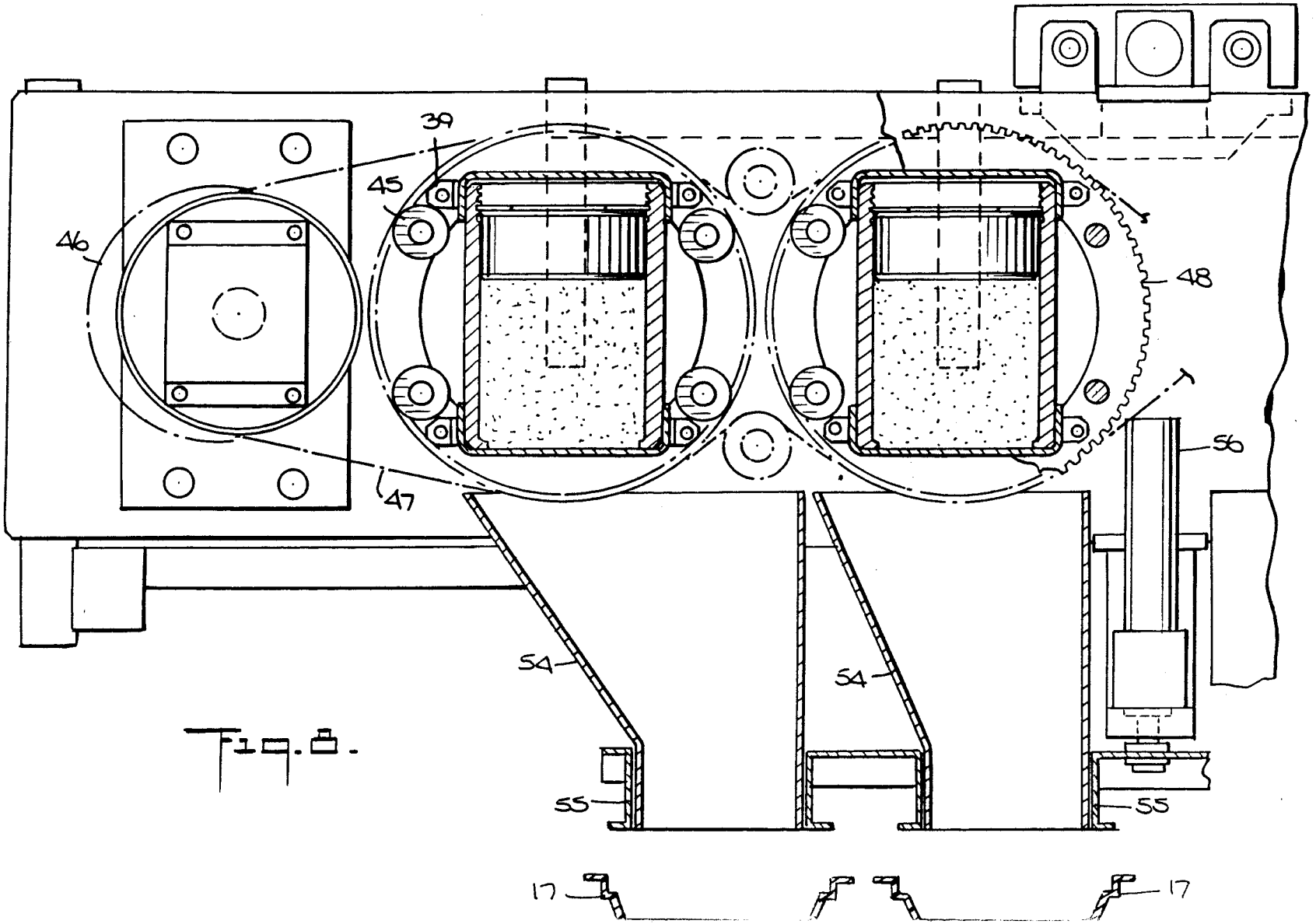
FIG. 8 is an end elevation view similar to FIG. 7 but taken at a different stage in the discharge cycle.

FIGS. 4–8 show details of the discharge device of the invention. Filled transfer receptacles 16 arrive on conveyor line 11 at input ends 31 of the discharge devices 15. Two of the four devices shown in FIG. 1 are illustrated in FIGS. 4, 7, and 8. It will be understood that the remaining devices are arranged in similar fashion.

The choice of number of discharge devices is based on the total throughput rate desired and on the operating rates of the other equipment in the system. For example, a typical discharge rate for one discharge device is 30 receptacles per minute. If the tray packaging equipment can process 120 trays per minute, and if the filling machine and conveyor line can supply filled receptacles at that rate, then four discharge devices in parallel are required.

Each discharge device extends transversely between a delivery segment 32 and a return segment 33 of the conveyor line 11. The delivery and return segments are supported in spaced-apart relation by a frame 34 which also supports a guide holder 35 of each discharge device. The guide holder comprises a pair of elongated deadplates 36 supported in parallel spaced-apart relation by an annular frame 37. Each deadplate is channel-shaped (see FIGS. 7 and 8) and attaches to a circular inner flange 38 of the frame by lugs 39 welded to the sides of the channel and bolted to the flange.

The width of the channels and the spacing between the deadplates is sufficient to allow the transfer receptacles to fit snugly, yet slide easily, between the deadplates. The length of each deadplate is sufficient to contain two contiguous transfer receptacles respectively at a first station 40, adjacent to the inlet end of the discharge device, and a second station 41, adjacent to the first station. As best shown in FIG. 4, each deadplate 36 is imperforate in the first station but has an opening 42 in the second station. As illustrated, the opening 42 is rectangular and extends to the output end of each deadplate. The width of opening 42 is approximately equal to the diameter of the top opening of a transfer receptacle, leaving edge portions 43 of the deadplate as tracks to support the receptacles as they slide through the guide holder and exit onto a fixed deadplate 44 at the outlet end of the guide holder. The fixed deadplate supports emptied transfer receptacles after they leave the guide holder until they move onto the return segment 33 of the conveyor line.

The inner face of the annular frame of each guide holder is supported on ball bearings 45 (FIGS. 7 and 8) so that the frame, and thus the guide holder, can rotate around its own centerline, which is parallel to the length dimension of deadplates 36. The ball bearings are supported by means (not shown) that connect to frame 34. A rotating means 46, such as a hydraulic rotary actuator, is coupled to the annular frame of each discharge device by a timing belt 47 that engages a toothed sprocket 48 formed on the external circumference of the frame. When the rotary actuator is actuated, it rotates all of the guide supports simultaneously and in synchronism. Conventional control means incorporating timers, limit switches, or other sensors (not shown), permit selective actuation of the rotary actuator to rotate the guide holders in successive 180° increments to invert each transfer receptacle at a predetermined stage of the operating cycle of the discharge device.

Each discharge device also includes means for shifting a transfer container from a location on the conveyor line 11 at the inlet end 31 of the discharge device to the first station 40 of the guide holder. In the illustrated embodiment the shifting means comprises a pusher bar 49 welded to a rod 50 that is mounted by a bracket 51 to the end of a piston rod 52 of a hydraulic or pneumatic linear actuator 53. The stroke of the linear actuator is preselected to move a transfer receptacle from the delivery segment 32 of the conveyor line (see leftmost receptacle in FIG. 5) fully into the first station of the guide holder (see leftmost receptacle approaching that position as the actuator nears the end of its stroke in FIG. 6).

Figure 9:
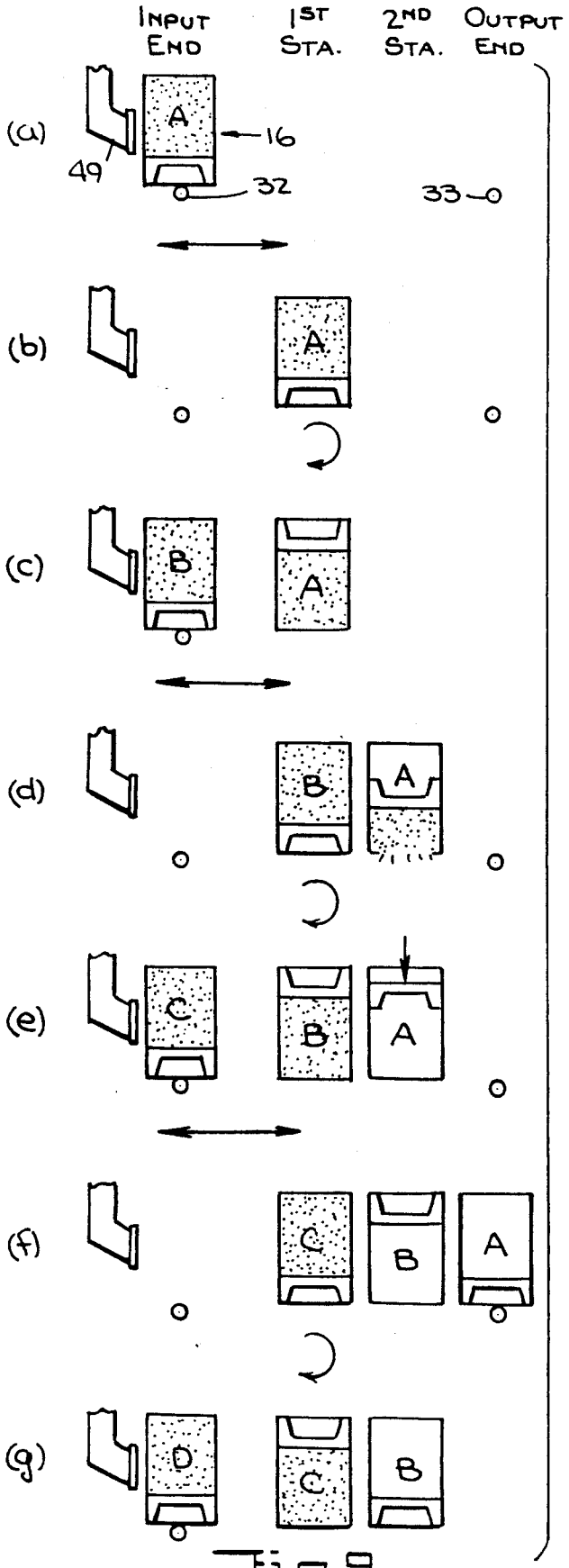
FIG. 9(*a*)(*g*) is a schematic flow diagram illustrating successive stages of a discharge cycle in an embodiment of a single discharge device.

The operation of the system is best explained in conjunction with the schematic step-by-step diagram of FIG. 9, with reference to FIGS. 1 and 48 for details.

In FIG. 9(*a*), a filled transfer container A arrives on the conveyor line at the input end of a discharge device. Between stages 9(*a*) and 9(*b*) the pusher bar is actuated to shift receptacle A to the first station in the guide holder. Between stages 9(*b*) and 9(*c*) the rotary actuator for the guide holder is actuated to rotate the guide holder by 180° . Thus, at stage 9(*c*), receptacle A has been inverted, and a receptacle B has arrived at the input end.

Between stages 9(*c*) and 9(*d*) the pusher bar is actuated to shift receptacle B into the first station. Receptacle B displaces the already inverted receptacle A into the second station to allow the contents of A to discharge through the opening in the deadplate. With particular reference to FIGS. 5 and 6, the contents enter a funnel 54 which directs the material into a tray 17.

The funnel has an outlet shield 55 which can be extended by an actuator 56 to seal the funnel to the tray and prevent any loss of material.

FIGS. 5 and 6 also show an optional device for assuring that all of the contents of the inverted receptacle in the second station are discharged. In the illustrated embodiment, this device comprises a nozzle 57 positioned above the second station for delivering an air blast into the receptacle to exert a downward pressure on the piston-like member 23. This pressure moves the member downward to positively expel all of the material in the receptacle (see FIG. 5). The air blast is delivered to the nozzle by selectively actuating a solenoid valve 58 in air line 59. Alternatively, more positive movement of the piston-like member can be obtained mechanically by selectively extending a push rod into the receptacle from a linear actuator (not shown) mounted above the guide support at the second station.

Between stages 9(*d*) and 9(*e*), the rotary actuator 46 is actuated to provide another 180° rotation of the guide holder. Consequently, at stage 9(*e*), receptacle A has been returned to the upright condition, receptacle B has been inverted, and a new receptacle C has arrived at the input end of the discharge device, thereby stopping the conveyor line. With particular reference to FIG. 6, another air blast is directed into the now upright receptacle in the second station to assure that the piston-like member 23 slides back down against the stop 25. The empty receptacle is then ready to return to the filling machine to receive another predetermined amount of material.

The pusher bar is then actuated once more to shift receptacle C into the first station, inverted receptacle B into the second station, and upright receptacle A out of the guide holder, as shown in stage 9(*f*). Receptacle B discharges its contents during this shift.

Rotary actuator 46 is then reactuated to cause another 180° rotation of the guide holder. This leads to stage 9(*g*) where receptacle B has been returned upright, receptacle C has been inverted, and a new receptacle D has arrived at the inlet end. In the embodiment illustrated in FIGS. 4–8, receptacle A would still be sitting on the fixed deadplate next to the outlet end of the guide holder, and would not move onto the return segment of the conveyor line until the next pusher actuation. This fixed deadplate position is not essential, however, and the return segment of the conveyor line could be located adjacent to the outlet end of the guide holder. This arrangement has been assumed in the diagram of FIG. 9, so that receptacle A is removed upon entering the conveyor line 33 between stages 9(*f*) and 9(*g*).

From the above description, it is clear that the apparatus operates in the following cycle:

(1) sense arrival of filled receptacle;
(2) actuate shifting means (pusher bar) for one cycle;
(3) actuate rotating means (rotary actuator) for one cycle.

These steps are repeated in order and can be automated by providing means for synchronizing operation of the shifting means and the rotating means so as to actuate the shifting means for one cycle in response to the arrival of a transfer receptacle at the input end of the discharge device and to actuate the rotation means for one cycle in response to completion of an actuating cycle of the shifting means. The design of such a synchronizing means using conventional sensors, such as limit switches or proximity sensors, and relays is within the skill of the art, given the above described operating sequence.

Figure 10:
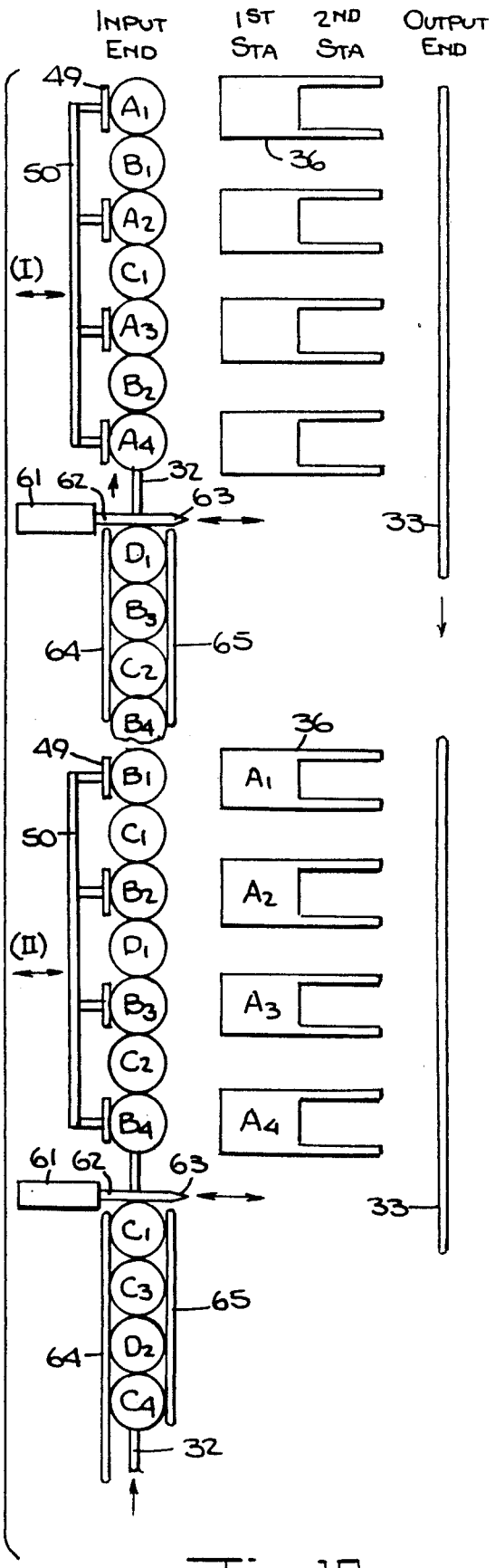
FIG. 10 is a schematic flow diagram illustrating successive stages of a partial discharge cycle in an embodiment having four discharge devices in parallel.

The above description covers the operation of a single discharge device. FIG. 10 illustrates schematically two stages in a cycle of operation of four discharge devices in parallel. When a plurality of discharge devices are used in parallel, it is important that a filled transfer receptacle be aligned with the input end of each discharge device. Because of the space required for the guide support rotating mechanisms, the specific receptacles for entering the respective discharge devices for a given actuation of the shifting means must be spaced apart on the conveyor line. In other words, it is necessary to space the receptacles on the conveyor line to match the spacing of the discharge devices.

It is also highly desirable to operate the conveyor line continuously, not to stop and restart the line in synchronism with the operating cycles of the shifting means and the rotating means. FIG. 10 shows a simple solution both to the problem of aligning receptacles with the input ends of the discharge devices and to the problem of preventing the pressure of receptacles bunched up on the conveyor line from interfering with operation of the shifting means. To solve the first problem, the spacing of the input ends of adjacent discharge devices is set to equal an integral multiple of transfer receptacle diameters. Preferably, this should be the minimum number required by the size of the annular frames of the guide supports. In the illustrated embodiment, the input ends are spaced apart by two receptacle diameters. This allows the transfer receptacles to automatically provide their own spacing, thereby avoiding the need for complex gate and control systems.

The solution to the second problem is to provide a simple gate mechanism at the entrance to the delivery zone that normally holds back the filled transfer receptacles arriving from the filling apparatus and retracts periodically, in response to completion of each cycle of the shifting means, to permit a number of receptacles equal to the number of discharge devices to pass into the delivery zone. As shown in FIG. 10, the gate mechanism comprises a linear actuator: for example, a pneumatic cylinder 61 and piston driven actuator rod 62. The rod is tipped preferably with a pointed plastic head or tip 63 which inserts easily between two contiguous receptacles after the predetermined number of receptacles has entered the delivery zone.

With reference particularly to stage (I) of FIG. 10, a total of seven filled transfer receptacles have been introduced into the delivery zone, and the actuator rod 62 is extended to bar entry of further receptacles, which back up behind the rod on the continuously moving conveyor delivery segment 32. The receptacles behind the rod are kept in alignment by side rails 64 and 65 on each side of the conveyor line. Within the delivery zone, the initial four receptacles $A_1$, $A_2$, $A_3$, and $A_4$ set for entry into the respective discharge devices are spaced apart by the additional three receptacles $B_1$, $C_1$, and $B_2$, respectively. (The reason for identifying the additional receptacles by these letters and subscripts will become apparent from the following discussion). The three spacer receptacles align the first, or "A", group of receptacles properly with the input ends of the respective discharge devices.

The four pusher bars 49 mounted to rod 50 are then moved by the shifting means to push the "A" receptacles into the first stations of the respective guide supports; then the shifting means retracts to complete its cycle.

Because there are only seven receptacles within the delivery zone, there is insignificant pressure exerted on the contiguous cans as a result of the continued running of the conveyor line, and the pusher bars can extend and retract without interference from the "spacer" receptacles. In addition, there is no significant pressure exerted to force the receptacles off the conveyor line and into the open input ends of the discharge devices, apart from the operation of the shifting means.

After the shifting means has completed its cycle, the rotating means turns the guide supports in a 180 degree increment, as described before in connection with FIG. 9. Also in response to completion of the shifting cycle, the actuator 61 retracts rod 62 to allow the next four filled receptacles, identified as $D_1$, $B_3$, $C_2$, and $B_4$, to enter the delivery zone. A suitable sensor (not shown) counts off the next four receptacles and then sends a signal to a programmable controller of conventional design to again extend the rod 62. As the conveyor line continues to move, the additional three receptacles of the first group and the newly admitted further four receptacles move to close up the gaps left by receptacles $A_1$, $A_2$, $A_3$, and $A_4$, which have shifted into the first stations of the discharge devices. Stage (II) of FIG. 10 illustrates this state of the discharge cycle.

The programmable controller then continues to alternate the actuation cycle of the shifting means with the actuation cycles of the rotating means and the pneumatic actuator gate in the same manner as described for FIG. 9.

The invention is not limited to discharge devices having rotating guide holders with two stations, so that the transfer receptacles can be inverted by a 180 degree rotational increment in the first station and returned to the upright condition by the next 180 degree rotational increment after shifting to the second station. By using a transfer receptacle designed so that either end can be a top or a bottom, the need for the second rotational increment can be avoided, and the length of the guide holder need be only enough to hold one transfer receptacle.

Figure 11:
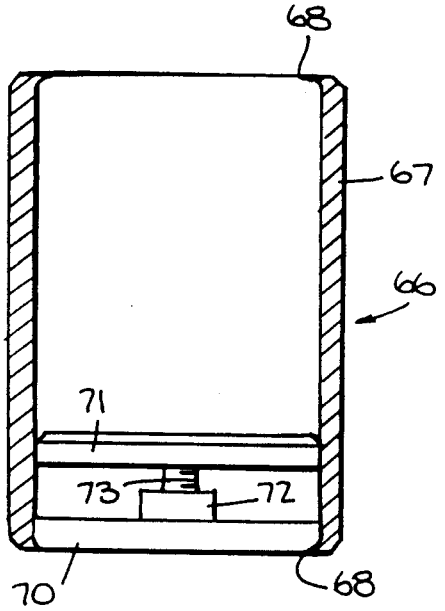
FIG. 11 is a longitudinal cross section of an alternative embodiment of a transfer receptacle.

FIG. 11 illustrates one design of such a transfer receptacle 66. The receptacle has a hollow open ended cylindrical body 67 provided with an inner retaining lip 68 at each end. A piston-like member 69 slidably mounted inside the body comprises first and second disks 70 and 71, respectively. The first disk has an internally threaded nut 72 attached to one face, and the second disk carries a mating externally threaded stud 73. The spacing between the disks can be adjusted by rotating one with respect to the other to screw the stud into or out of the nut, thereby providing a selectable variable capacity for the receptacle. Since the two disks serve as the heads of a double-ended piston, either end of the body can serve as an open top for the receptacle when the piston-like member rests against the inner lip at the other end of the body.

Figure 12:
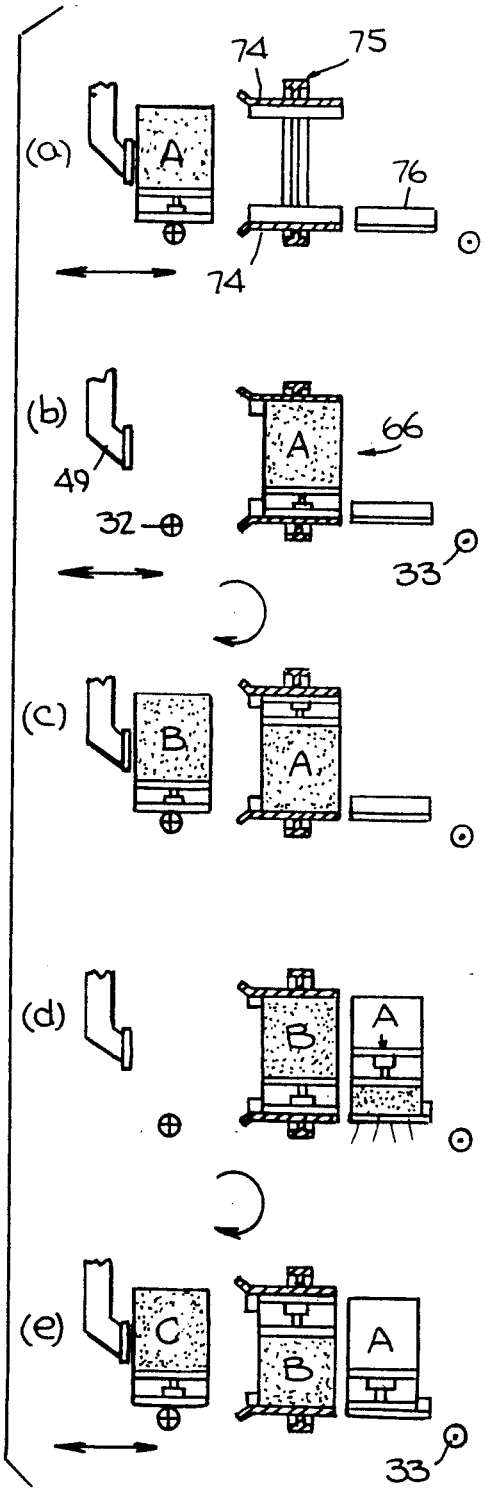
FIG. 12(*a*)–(*e*) is a schematic flow diagram illustrating successive stages in an alternative embodiment of a discharge cycle using the transfer receptacle of FIG. 11.

FIG. 12 illustrates schematically a modified apparatus for delivering predetermined amounts of material from receptacles of the type shown in FIG. 11 to a succession of containers. In this modified apparatus, the guide members 74 of the rotatable guide holder 75 are long enough to accommodate only one receptacle because there is no need to return the receptacles to their original orientation. In the second station, where discharge occurs, there is only a fixed lower guide support 76, which may comprise a pair of laterally spaced angle iron rails, so that the contents of the receptacle inverted in the first station can fall through the opening between them (see step (d)). The alternation of shifting and rotating cycles is the same as was described in connection with FIG. 9 and need not be repeated here. Following the stage illustrated in FIG. 12(*e*), the next shifting step moves the empty receptacle A to the return segment 33 of the conveyor at the output end of the device. Although the receptacle is inverted from its original condition, the symmetry of the body and the double-ended piston allow what was previously a bottom end closed by the piston to become an open top, and vice-versa.

The device pictured schematically in FIG. 12 is simpler and less expensive to construct than the two station rotary guide holder of the previously described embodiment. Nevertheless, it will be appreciated that the double-ended piston transfer receptacle of FIG. 11 can equally well be used with a rotary two station discharge device.

Although a preferred embodiment of the invention has been described, it will be apparent to those skilled in the art that the scope of the invention permits substitution of different elements to perform equivalent functions.

I claim:

1. Apparatus for transferring a predetermined amount of material from each of a plurality of open top transfer receptacles to each of a succession of containers, the volume of each transfer receptacle being equal to the volume of the predetermined amount of material to be delivered to each container, the transferring apparatus comprising:

an input end for receiving filled transfer receptacles and an output end for returning empty transfer receptacles;

a guide holder comprising a pair of elongated parallel spaced apart deadplates extending from the input end in a predetermined direction, the spacing of the deadplates being sufficient to slidably receive the height of a transfer receptacle, the length of the deadplates being sufficient to contain two contiguous transfer receptacles in a first station located adjacent to the input end and in a second station located next to the first station in the predetermined direction, respectively, each deadplate being imperforate in the first station and having an opening in the second station for permitting discharge of the contents of a transfer receptacles through the open top of the receptacle;

means for shifting a transfer receptacle from a location adjacent to the input end of the apparatus to the first station in the guide holder; and means for rotating the guide holder in 180 degree increments about an axis parallel to the length dimension of the deadplates.

2. The apparatus of claim 1 further comprising control means for synchronizing operation of the receiving of transfer receptacles, the shifting means, and the rotating means so as to stop the receiving of transfer receptacles and actuate the shifting means for one cycle in response to the arrival of a transfer receptacles at the input end and to start the receiving of a transfer receptacle and to actuate the rotating means for a 180 degree cycle in response to completion of an actuation cycle of the shifting means, the actuation of the rotating means enabling the predetermined amount of material to be delivered to a container.

3. The apparatus of claim 1 further comprising means for transporting filled transfer receptacles to the input end of the transferring apparatus and means for returning empty receptacles, said transporting and returning means including an endless conveyor line having a delivery segment that extends adjacent to the input of the delivery apparatus and a return segment that extends adjacent to the output end of the delivery apparatus.

4. The apparatus of claim 3 wherein the means for shifting a receptacle into a first station of the guide holder comprises a linear actuator movable between a first position and a second position and a pusher member connected to the actuator so as to move a receptacle from said location adjacent to the input end of the apparatus into the first station when the actuator moves from the first to the second position.

5. The apparatus of claim 1 wherein the guide holder further comprises an annular frame surrounding the pair of deadplates, the frame having a central axis extending parallel to the longitudinal dimension of the deadplates, means for attaching the deadplates to the frame, and means for mounting the frame for rotation about its central axis.

6. The apparatus of claim 5 wherein the means for rotating the guide holder comprises a rotary drive means and means for coupling the rotary drive means in positive, non-slip relation to the annular frame of the guide holder.

7. The apparatus of claim 6 wherein the means for coupling the rotary drive means to the annular frame comprises a toothed pinion mounted concentrically on the frame and a mating timing belt connecting the rotary drive means to the pinion.

8. The apparatus of claim 1 wherein each transfer receptacle comprises:

a hollow cylindrical body having an open bottom and an open top;

a piston-like member slidably fitted in the cylindrical body; and a stop mounted at one of a plurality of predetermined axially spaced locations adjacent to the bottom of the body to provide a corresponding plurality of predetermined amounts of material to be disposed in the receptacle when the piston-like member is resting against the stop.

9. The apparatus of claim 8 and further comprising means located at the second station for urging the piston-like member of a transfer receptacle located in said second station toward the top of the receptacle body to assure complete discharge of the contents of the receptacle.

10. A device for discharging material from each of a series of filled open top transfer receptacles to each of a succession of containers, the device comprising:

an input end for receiving filled transfer receptacles and an output end for returning empty transfer receptacles;

a guide holder having a set of elongated parallel spaced apart guide members extending from the input end of the device toward the output end of the device, the spacing of the guide members being sufficient to slidably receive and support a transfer receptacle, the length of the guide members being sufficient to contain at least one transfer receptacle, and the guide members providing an opening for permitting discharge of the contents of a transfer receptacle through the open top of the receptacle;

means for shifting a filled transfer receptacle from a location adjacent to the input end of the discharge device into the first station of the guide holder; and means for selectively rotating the guide holder in 180 degree increments about an axis parallel to the longitudinal dimension of the guide members.

11. The device of claim 10 wherein each transfer receptacle comprises a hollow open ended cylindrical body; a piston-like member slidably mounted inside the body, the body including means at each open end for preventing the piston-like member from sliding out of the body, the piston-like member including first and second axially spaced disks, the first disk having an internally threaded nut secured to one face, and the second disk having a mating externally threaded stud secured to a face opposing the one face of the first disk, the spacing between the disks being adjustable by rotating one disk with respect to the other to screw the stud into or out of the nut, thereby providing a selectable variable capacity for the receptacle.

12. The apparatus of claim 11 wherein the apparatus further comprises means located adjacent to the guide holder for urging the piston-like member of a transfer receptacle located in the guide holder downward in the body of the receptacle.

13. Apparatus for transferring a predetermined amount of material from each of a plurality of open top transfer receptacles to each of a succession of containers, the volume of each transfer receptacle being equal to the volume of the predetermined amount of material to be delivered to each container, the transferring apparatus comprising:

an input end for receiving filled transfer receptacles and an output end for returning empty transfer receptacles;

a guide holder comprising a pair of elongated parallel spaced apart deadplates extending from the input end in a predetermined direction, the spacing of the deadplates being sufficient to slidably receive the height of a transfer receptacle, the length of the deadplates being sufficient to contain a transfer receptacle in a first station located adjacent to the input end, the first station being located next to a second station in the predetermined direction, the second station having an opening for permitting discharge of the contents of a transfer receptacle through the open top of the receptacle when the transfer receptacle is inverted;

means for rotating the guide holder in 180 degree increments about an axis parallel to the length dimension of the deadplates to invert a filled receptacle at the first station; and means for shifting an inverted transfer receptacle from a location adjacent to the input end of the apparatus to the first station in the guide holder for discharging the contents of the inverted transfer receptacle through the opening at the second station.

14. The apparatus of claim 13 wherein the means for shifting a receptacle into the first station of the guide holder comprises a linear actuator movable between a first position and a second position and a pusher member connected to the actuator so as to move a receptacle from said location adjacent to the input end of the apparatus into the first station when the actuator moves from the first to the second position and thereby moving a receptacle in the first station to the second station.

15. The apparatus of claim 13 wherein each transfer receptacle comprises:

a hollow cylindrical body having an open bottom and an open top;

a piston-like member slidably fitted in the cylindrical body; and a stop mounted at one of a plurality of predetermined axially spaced locations adjacent to the bottom of the body to provide a corresponding plurality of predetermined amounts of material to be disposed in the receptacle when the piston-like member is resting against the stop.

16. The apparatus of claim 15 and further comprising means located at the second station for urging the piston-like member of a transfer receptacle located in said second station toward the top of the receptacle body to assure complete discharge of the contents of the receptacle.

17. The apparatus of claim 13 wherein each transfer receptacle comprises a hollow open ended cylindrical body; a piston-like member slidably mounted inside the body, the body including means at each open end for preventing the piston-like member from sliding out of the body, the piston-like member including first and second axially spaced disks, the first disk having an internally threaded nut secured to one face, and the second disk having a mating externally threaded stud secured to a face opposing the one face of the first disk, the spacing between the disks being adjustable by rotating one disk with respect to the other to screw the stud into or out of the nut, thereby providing a selectable variable capacity for the receptacle.

18. The apparatus of claim 17 wherein the apparatus further comprises means located adjacent to the guide holder for urging the piston-like member of a transfer receptacle located in the guide holder downward in the body of the receptacle.

19. A method for delivering a predetermined amount of material to a container comprising receiving at a delivery zone transfer receptacles each filled with a predetermined amount of material to be delivered to a container, discharging the predetermined amount filled into each successive transfer receptacle into a succession of containers at a delivery zone, and returning the empty transfer receptacles for subsequent filling, wherein the step of discharging the contents of successive transfer receptacles comprises:

(a) shifting a filled transfer receptacle upon arrival at the delivery zone into a first station adjacent to the arriving containers;

(b) rotating the receptacle in the first station 180° about an axis parallel to the shifting direction while covering the open top of the receptacle to prevent discharge of the contents therefrom;

(c) shifting a subsequently arriving filled transfer receptacle into the first station, the latter receptacle displacing the inverted previous receptacle into a second station adjacent to the first station;

(d) uncovering the open top of the inverted receptacle in the second station to discharge the contents of that receptacle into one of a line of containers passing underneath the delivery zone;

(e) rotating the receptacles in the first station 180° about the axis defined in step (b); and (f) repeating steps (c) and (e) as successive filled receptacles arrive at the delivery zone.

20. The method of claim 19 wherein step (a) comprises shifting a filled transfer receptacle in a direction transverse to the path of the arriving filled transfer receptacles.

21. Apparatus for transferring a predetermined amount of material from each of a plurality of open top transfer receptacles to each of a succession of containers, the volume of each transfer receptacle being equal to the volume of the predetermined amount of material to be delivered to each container, the transferring apparatus comprising a plurality of assemblies disposed substantially parallel to and spaced apart with respect to one another at a predetermined distance which is a common multiple of the diameter of the transfer receptacle, each assembly having:

an input end for receiving filled transfer receptacles and an output end for returning empty transfer receptacles;

a guide holder comprising a pair of elongated parallel spaced apart deadplates extending from the input end in a predetermined direction, the spacing of the deadplates being sufficient to slidably receive the height of a transfer receptacle, the length of the deadplates being sufficient to contain two contiguous transfer receptacles in a first station located adjacent to the input end, the first station being located next to a second station in the predetermined direction, the second station having an opening for permitting discharge of the contents of a transfer receptacle through the open top of the receptacle when the transfer receptacle is inverted;

means for rotating the guide holder in 180 degree increments about an axis parallel to the length dimension of the deadplates to invert a filled receptacle at the first station; and means for shifting an inverted transfer receptacle from a location adjacent to the input end of the apparatus to the first station in the guide holder for discharging the contents of the inverted transfer receptacle through the opening at the second station.

* * * * *

UNITED STATES PATENT AND TRADEMARK OFFICE

CERTIFICATE OF CORRECTION

PATENT NO. : 4,953,600

DATED : 9/4/90

INVENTOR(S) : CLAUDE TRIBERT

It is certified that error appears in the above-identified patent and that said Letters Patent is hereby corrected as shown below:

Column 10, line 49, delete "receptacles" and insert --receptacle--;

Column 10, line 62, delete "receptacles" and insert --receptacle--;

Column 11, line 6, delete "input of" and insert --input end of--; and

Column 14, line 13, delete "(c) and (e)" and insert --(c) through (e)--.

Signed and Sealed this

Seventeenth Day of March, 1992

*Attest:*

HARRY F. MANBECK, JR.

*Attesting Officer*

*Commissioner of Patents and Trademarks*